US007837309B2

(12) United States Patent
Owaki

(10) Patent No.: US 7,837,309 B2
(45) Date of Patent: Nov. 23, 2010

(54) LIQUID EJECTING HEAD AND METHOD FOR ASSEMBLING SAME

(75) Inventor: Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 825 days.

(21) Appl. No.: 11/682,983

(22) Filed: Mar. 7, 2007

(65) Prior Publication Data

US 2007/0273732 A1 Nov. 29, 2007

(30) Foreign Application Priority Data

Mar. 8, 2006 (JP) ..... 2006-062025
Feb. 23, 2007 (JP) ..... 2007-044238

(51) Int. Cl.
*B41J 2/175* (2006.01)

(52) U.S. Cl. ..... 347/85

(58) Field of Classification Search ..... None
See application file for complete search history.

(56) References Cited

U.S. PATENT DOCUMENTS 6,945,643 B2 * 9/2005 Tajima et al. ..... 347/87

FOREIGN PATENT DOCUMENTS

| | | |
|---|---|---|
| JP | 11-227228 | 8/1999 |
| JP | 2004-074676 | 3/2004 |
| JP | 2004-142453 | 5/2004 |
| JP | 2005-111885 | 4/2005 |

* cited by examiner

*Primary Examiner*—Stephen D Meier
*Assistant Examiner*—Alexander C Witkowski
(74) *Attorney, Agent, or Firm*—Workman Nydegger

(57) ABSTRACT

To provide a liquid ejecting head that has a simple structure for attaching an introduction needle holder to a case member and whose width in the main scanning direction can be reduced, and a method for assembling the same. A case member includes a head unit attachment portion to which a head unit is attached, a holder attachment portion that is located on the opposite side from the head unit attachment portion and to which the introduction needle holder is attached, and a supporting wall provided on one side of the holder attachment portion. The supporting wall has an engaging claw on the introduction needle holder side surface thereof. The introduction needle holder has an engaged claw capable of being engaged with the engaging claw at one end thereof. There is formed an introduction needle holder fixing portion that fixes the other end of the introduction needle holder to the holder attachment portion of the case member.

13 Claims, 7 Drawing Sheets

LIQUID EJECTING HEAD AND METHOD FOR ASSEMBLING SAME

TECHNICAL FIELD

The present invention relates to a liquid ejecting head such as an ink jet recording head, and more specifically, it relates to a liquid ejecting head including an introduction needle holder and a case member, one of these members being disposed on the top of the other, and a method for assembling the same.

BACKGROUND ART

Liquid ejecting heads that causes pressure fluctuation In liquid in a pressure chamber and thereby discharges the liquid from nozzle openings in the form of liquid drops include, for example, ink jet recording heads used in image forming apparatuses such as printers, color material ejecting heads used for manufacturing color filters of liquid crystal displays, electrode material ejecting heads used for forming electrodes of organic EL (Electro Luminescence) displays and FEDs (field emission displays), and bioorganic matter ejecting heads used for manufacturing biochips. There are various types of such liquid ejecting heads.

For example, some ink jet recording heads (hereinafter referred to as "recording head") for an ink jet recording apparatus (hereinafter referred to as "printer") includes a head unit and a case member (head case). The head unit includes a flow path unit, a nozzle plate, an actuator unit, and so forth. The flow path unit includes continuous liquid flow paths leading to nozzle openings via pressure chambers. The nozzle plate includes a plurality of aligned nozzle openings communicate with the liquid flow paths. The actuator unit includes pressure generating elements capable of changing the capacities of the pressure chambers. The case member is formed of a resin. To the case member are fixed the head unit and an introduction needle holder (a base). The introduction needle holder includes liquid introduction needles that introduce liquid in a liquid holding member into liquid flow paths communicating with the pressure chambers.

In such recording heads, when the introduction needle holder and the case member are joined, a packing member and a wiring substrate are interposed between these members, the packing member connecting the liquid flow paths, the wiring substrate supplying a drive signal to the actuator unit, and then flange portions extending from the case member is screwed at three locations to the introduction needle holder (see, for example, JP-A-2004-74676).

DISCLOSURE OF THE INVENTION

Figure 1:
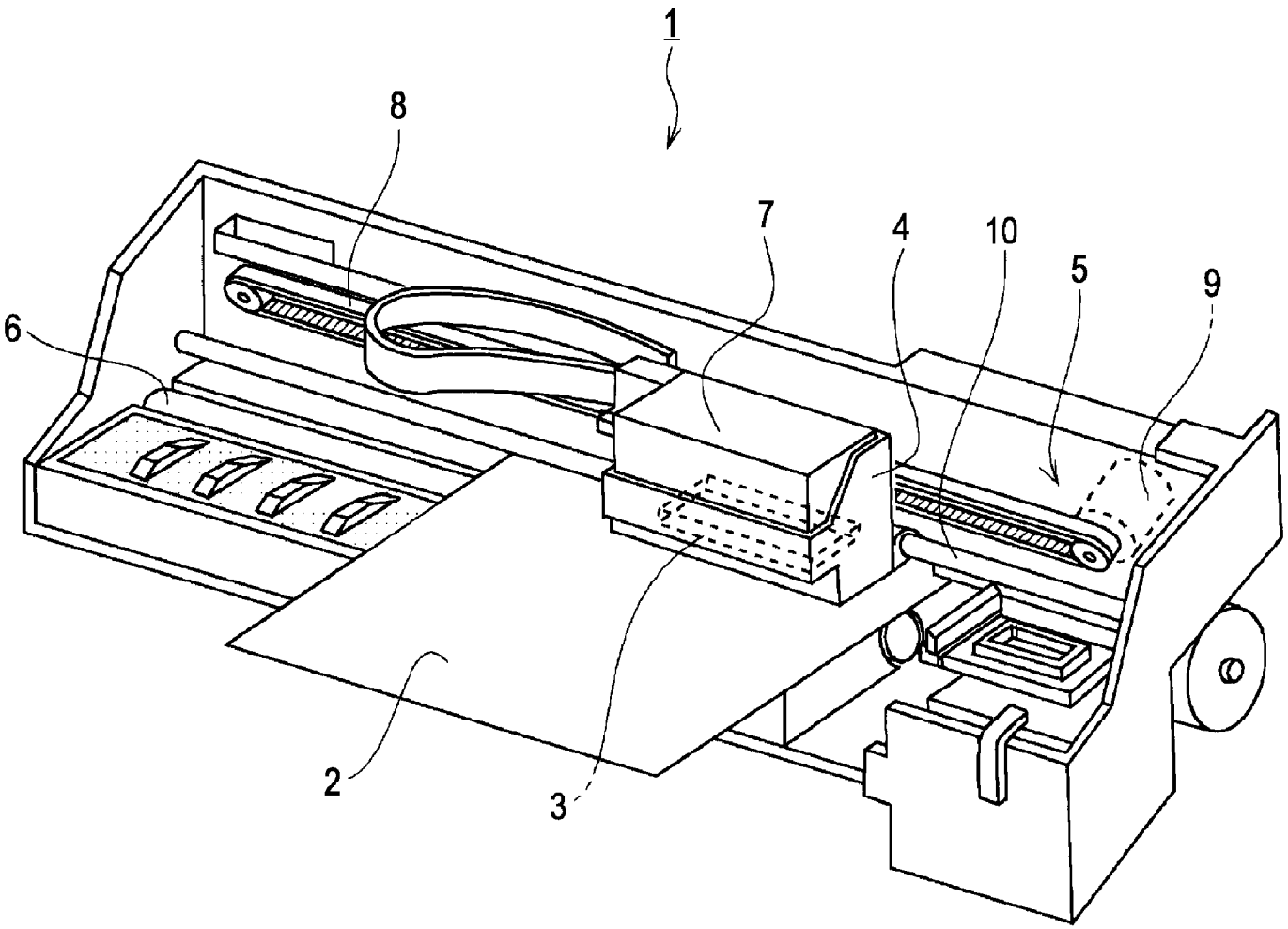
FIG. 1 is a perspective View illustrating the structure of a printer.

For printers including this kind of recording head, nowadays, the sizes of their bodies tend to be reduced in order to meet the need for compactness. However, since the screwing points for joining the introduction needle holder and the case member are located in the flange portions extending from the case member, the width of the recording head in the main scanning direction cannot be easily reduced. Therefore, it is difficult to reduce the widths of the printer bodies in the main scanning direction.

The invention is made in View of such circumstances, and an object thereof is to provide a liquid ejecting head that has a simple structure for attaching an introduction needle holder to a case member and whose width in the main scanning direction can be reduced, and a method for assembling the same.

To attain the above object, a liquid ejecting head of the invention includes:

a case member including a head unit including a nozzle line having a plurality of aligned nozzle openings, the head unit being capable of discharging liquid in a pressure chamber from the nozzle openings in the form of liquid drops by driving a pressure source; and an introduction needle holder including an introduction needle introducing liquid in a liquid holding member into a liquid flow path communicating with the pressure chamber, wherein the introduction needle holder includes a holder side liquid flow path that supplies liquid introduced from the liquid introduction needle to the case member side, the case member includes a case side liquid flow path that supplies liquid supplied from the holder side liquid flow path of the introduction needle holder to the pressure chamber side, the case member includes a head unit attachment portion to which the head unit is attached, a holder attachment portion that is located on the opposite side from the head unit attachment portion and to which the introduction needle holder is attached, and a supporting wall provided on one side of the holder attachment portion, the supporting wall has an engaging claw on the introduction needle holder side surface thereof, and the introduction needle holder has an engaged claw capable of being engaged with the engaging claw and provided at one end thereof, the liquid ejecting head further including an introduction needle holder fixing portion that fixes the other end of the introduction needle holder to the holder attachment portion of the case member.

According to the above constitution, the case member includes a head unit attachment portion to which the head unit is attached, a holder attachment portion that is located on the opposite side from the head unit attachment portion and to which the introduction needle holder is attached, and a supporting wall provided on one side of the holder attachment portion, the supporting wall has an engaging claw on the introduction needle holder side surface thereof, and the introduction needle holder has an engaged claw capable of being engaged with the engaging claw and provided at one end thereof, the liquid ejecting head further including an introduction needle holder fixing portion that fixes the other end of the introduction needle holder to the holder attachment portion of the case member. Therefore, the number of components can be reduced, and the structure for attaching the introduction needle holder to the case member is simple. Therefore, the attachment work can be simplified, and the working efficiency can be improved. In addition, In the case where the supporting wall provided with the engaging claw and the introduction needle holder fixing portion are provided In the main scanning direction of the liquid ejecting head, it is not necessary to screw the introduction needle holder to flange portions extending from the case member in the subs canning direction, unlike the known art. Therefore, the width of the liquid ejecting head in the main scanning direction can be reduced.

In the above constitution, it is preferable that one of the case member and the introduction needle holder be provided with a protrusion protruding toward the other, the other be provided with a recess into which the protrusion can be fitted, at least one of the protrusion and the recess be provided with a tapered sliding surface that slides and thereby guides the attachment direction, a packing member for connecting the holder side liquid flow path and the case side liquid flow path with each other In a liquid-tight manner be disposed between the case member and the introduction needle holder, and the protrusion and the recess engage with each other before the packing member is pinched between the case member and the introduction needle holder when the introduction needle holder is attached to the holder attachment portion.

In this case, the protrusion and the recess engage with each other before the packing member is pinched. Therefore, guided by the sliding surface, the case member and the introduction needle holder can approach each other along the attachment direction, and can pinch the packing member along the attachment direction. Therefore, a reaction force In a direction diagonal to the attachment direction can be prevented from acting on the packing member, and the packing member can be pressed uniformly. In addition, the sliding surface formed in at least one of the protrusion and the recess can guide the attachment direction of the case member and the introduction needle holder when the introduction needle holder is brought close to the holder attachment portion of the case member. Therefore, when a worker attaches the introduction needle holder to the case member, the protrusion and the recess can be prevented from interfering (coming into contact) with each other, the variation in the attachment direction can be reduced, and the working efficiency and attachability can be improved.

In the above constitution, it is preferable that the protrusion and the recess constitute the introduction needle holder fixing portion.

In this case, Since the introduction needle holder fixing portion provided in the liquid head doubles as a guide in the attachment direction of the case member and the introduction needle holder, no new member guiding the attachment direction is necessary.

In the above constitution, it is preferable that the case member include a wiring substrate that supplies a drive signal to the pressure source, the supporting wall be provided with a substrate base portion on the opposite side surface thereof from the surface on which the engaging claw is disposed, and the wring substrate be fixed to the substrate base portion.

In this case, Since the supporting wall is provided with a substrate base portion on the opposite side surface thereof from the surface on which the engaging claw is disposed and the wiring substrate is fixed to the substrate base portion, the holder attachment portion and the substrate base portion can be separated. If liquid leaks from the connecting portion between the holder side liquid flow path and the case side liquid flow path, the liquid can be prevented from reaching the wiring substrate side. Therefore, the liquid can be prevented from adhering to the wiring substrate, and the wiring substrate can be prevented from shorting out and being destroyed.

In the above constitution, it is preferable that the head unit include a flexible cable one end side terminal portion of which is connected to an input terminal portion of the pressure source and the other end side terminal portion of which is connected to a terminal portion of the wiring substrate, a sloping guide portion that downward slopes from the supporting wall side to the other side of the case member and an opening facing the sloping guide portion be provided In part of the proximal end side of the supporting wall, and when the head unit with the other end side terminal portion of the flexible cable upstanding from the pressure source is attached to the head unit attachment portion, the other end side terminal portion of the flexible cable be passed through the opening and be guided along the slope of the sloping guide portion from the head unit attachment portion side to the substrate base portion side.

In this case, the other end side terminal portion of the flexible cable is passed through the opening and is guided along the slope of the sloping guide portion from the head unit attachment portion side to the substrate base portion side. Therefore, the other end side terminal portion of the flexible cable can be surely guided to the substrate base portion side, the occurrence of defective assembling can be prevented, and the yield can be improved.

In each of the above constitutions, it is preferable that the holder attachment portion be provided with an upright portion on the supporting wall side thereof, the upright portion protruding toward the introduction needle holder, and the upper end of the upright portion be in contact with the lower portion of the introduction needle holder and thereby define the position of the introduction needle holder in the attachment direction.

In each of the above constitutions, it is preferable that the introduction needle holder fixing portion use screwing.

In each of the above constitutions, it is preferable that the introduction needle holder fixing portion use such caulking that a fixing pin provided In one of the case member and the introduction needle holder is passed through a through hole provided in the other and then the tip of the fixing pin protruding from the through hole is thermally deformed.

Another aspect of the invention is a method for assembling a liquid ejecting head including:

a case member including a head unit including a nozzle line having a plurality of aligned nozzle openings, the head unit being capable of discharging liquid in a pressure chamber from the nozzle openings in the form of liquid drops by driving a pressure source; and an introduction needle holder including an introduction needle introducing liquid in a liquid holding member into a liquid flow path communicating with the pressure chamber, wherein the introduction needle holder includes a holder side liquid flow path that supplies liquid introduced from the liquid introduction needle to the case member side, the case member includes a case side liquid flow path that supplies liquid supplied from the holder side liquid flow path of the introduction needle holder to the pressure chamber side, the case member includes a head unit attachment portion to which the head unit is attached, a holder attachment portion that is located on the opposite side from the head unit attachment portion and to which the introduction needle holder is attached, and a supporting wall provided on one side of the holder attachment portion, the supporting wall has an engaging claw on the introduction needle holder side surface thereof, and the introduction needle holder has an engaged claw capable of being engaged with the engaging claw and provided at one end thereof.

The method includes fixing the other end of the introduction needle holder to the holder attachment portion of the case member with the engaged claw engaged with the engaging claw.

According to the above constitution, the case member includes a head unit attachment portion to which the head unit is attached, a holder attachment portion that is located on the opposite side from the head unit attachment portion and to which the introduction needle holder is attached, and a supporting wall provided on one side of the holder attachment portion; the supporting wall has an engaging claw on the introduction needle holder side surface thereof; the introduction needle holder has an engaged claw capable of being engaged with the engaging claw and provided at one end thereof; and the method includes fixing the other end of the introduction needle holder to the holder attachment portion of the case member with the engaged claw engaged with the engaging claw. Therefore, the number of components can be reduced, and the structure for attaching the introduction needle holder to the case member is simple. Therefore, the attachment work can be simplified, and the working efficiency can be improved.

The best mode for carrying out the invention will now be described with reference to the accompanying drawings. In the embodiments described below, various limitations are made as preferred specific examples of the invention. However, the scope of the present invention is not limited to these embodiments unless there is any description to specifically limit the invention in the following description. An ink jet recording head (hereinafter simply referred to as "recording head") installed in an ink jet recording apparatus (a kind of liquid ejecting apparatus, hereinafter simply referred to as "printer") will be taken as an example of a liquid ejecting head of the invention in the following description.

First, the rough structure of the printer will be described with reference to FIG. 1. The printer 1 is an apparatus that discharges liquid ink onto the surface of a recording medium 2, for example, recording paper and thereby records, for example, an image. This printer 1 includes an ink jet recording head 3 (corresponding to a kind of liquid ejecting head of the invention, hereinafter referred to as "recording head) that discharges ink, a carriage 4 to which this recording head 3 is attached, a carriage moving mechanism 5 that moves the carriage 4 In the main scanning direction, a platen roller 6 that transports the recording medium 2 in the subscanning direction, and so forth. The ink is a kind of liquid of the invention and is held In an ink cartridge 7. This ink cartridge 7 is detachably attached to the recording head 3.

The carriage moving mechanism 5 includes a timing belt 8. This timing belt 8 is driven by a pulse motor 9 such as a DC motor. Therefore, when the pulse motor 9 operates, the carriage 4 reciprocates in the main scanning direction (the width direction of the recording medium 2), being guided by a guide rod 10 provided across the printer 1.

Figure 2:
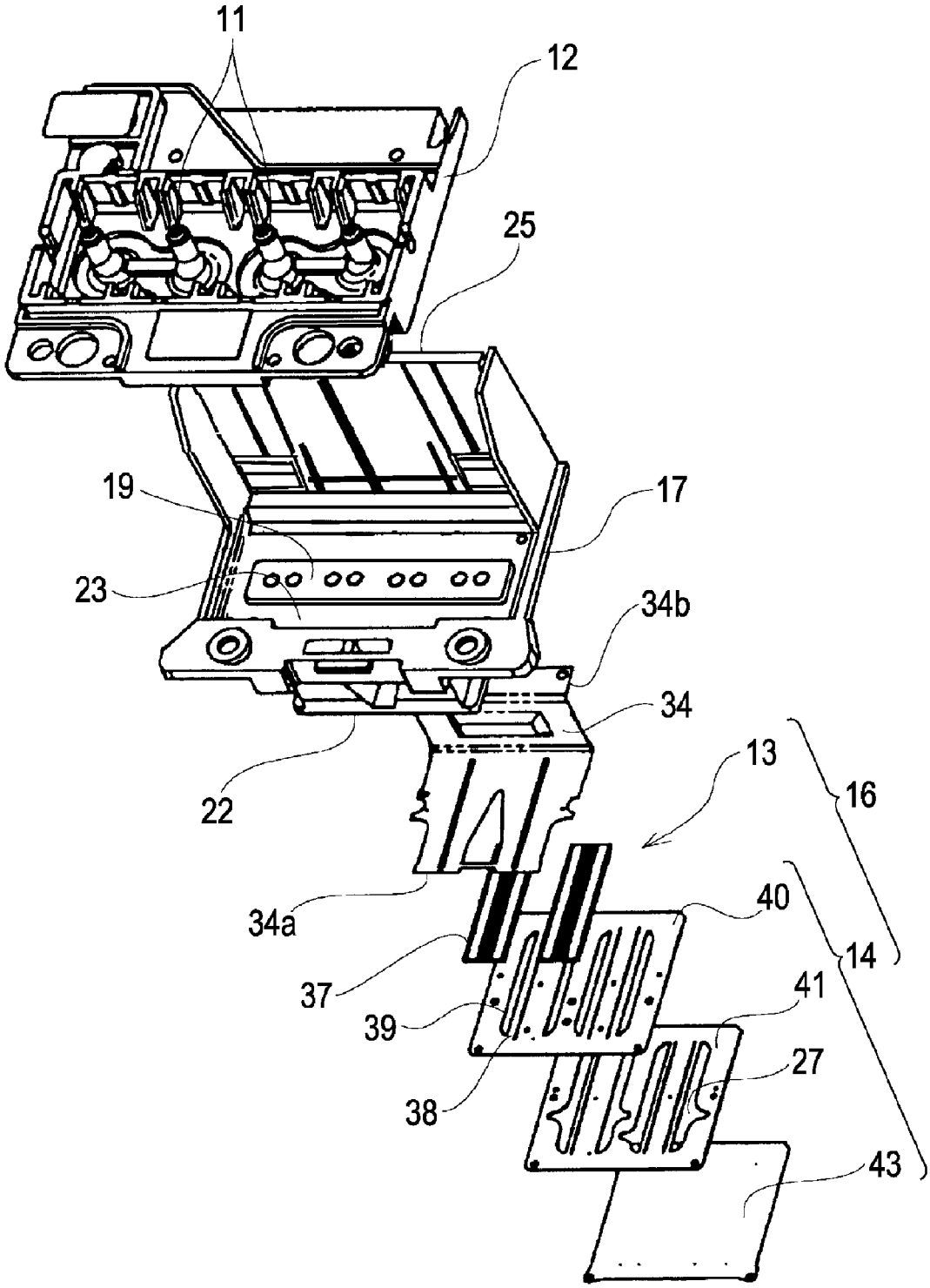
FIG. 2 is an exploded upper perspective view of a recording head.
Figure 3:
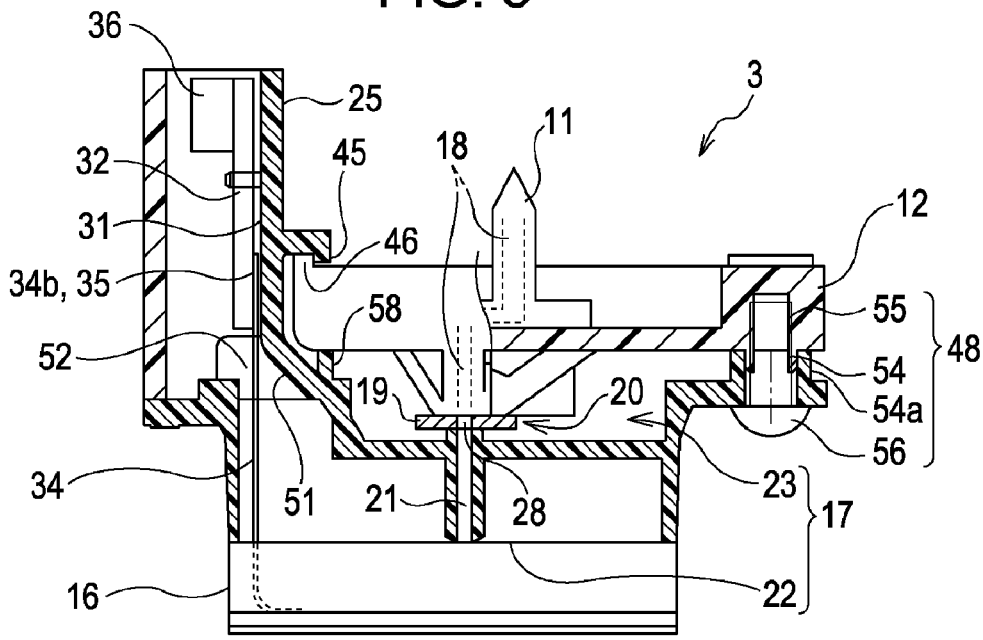
FIG. 3 is a sectional view of a main part of the recording head.

FIGS. 2 and 3 illustrate the structure of the recording head 3. FIG. 2 is an exploded upper perspective view of the recording head 3. FIG. 3 is a sectional view of a main part of the recording head 3. This recording head 3 roughly includes an introduction needle holder 12, a head unit 16, and a case member 17 holding the introduction needle holder 12 and the head unit 16. The introduction needle holder 12 is provided with a plurality of ink introduction needles 11 (a kind of liquid introduction needles) that introduce the ink (a kind of liquid) in the ink cartridge 7 into liquid flow paths in the recording head 3. The head unit 16 includes an actuator unit 13 and a flow path unit 14. In this embodiment, as shown In FIG. 3, the tip of each ink introduction needle 11 is sharp. However, the invention is not limited to this shape. Needles whose tips are not sharp can also be used as the ink introduction needles 11.

The introduction needle holder 12 is formed of a synthetic resin, for example, an epoxy resin. To the upper surface thereof are attached a plurality of ink introduction needles 11. A filter is interposed between the upper surface and each ink introduction needle 11. To these ink introduction needles 11 is to be attached a liquid holding member, for example, the ink cartridge 7 or a subtank (not shown) holding ink. Inside this introduction needle holder 12, as shown in FIG. 3, are formed holder side liquid flow paths 18 that supply the case member 17 side with ink introduced from the ink introduction needles 11. The upstream sides of these holder side liquid flow paths 18 communicate with the ink introduction needles 11 via the filters. The downstream side openings thereof communicate with case side liquid flow paths 21 formed inside the case member 17, via a connecting portion 20 including a packing member 19.

The case member 17 is formed of a synthetic resin, for example, an epoxy resin and is a hollow box-like member. As shown in FIGS. 2 and 3, the case member 17 includes a head unit attachment portion 22 to which the head unit 16 is attached, and a holder attachment portion 23 that is located on the opposite side from the head unit attachment portion 22 and to which the introduction needle holder 12 is attached. The holder attachment portion 23 has a supporting wall 25 provided on one side thereof. To the holder attachment portion 23 is attached the introduction needle holder 12 with the packing member 19 interposed therebetween. More of this below.

Inside the case member 17 and therethrough in the height direction are provided the case side liquid flow paths 21. As shown in FIG. 3, the upstream side openings of these case side liquid flow paths 21 open at positions higher than the bottom surface of the holder attachment portion 23, and communicate with the holder side liquid flow paths 18 of the introduction needle holder 12 via the connecting portion 20 including the packing member 19. The downstream sides of the case side liquid flow paths 21 communicate with reservoirs 27 In the flow path unit 14. Therefore, introduced from the ink introduction needles 11, ink in the cartridge 7 is supplied to the reservoirs 27 side via the holder side liquid flow paths 18 and the case side liquid flow paths 21 (which correspond to the liquid flow paths in the invention), and is distributed to the pressure chambers via these reservoirs 27.

The packing member 19 interposed between the introduction needle holder 12 and the case member 17 is a plate-like member formed of an elastic material, for example, elastomer or rubber, and has communication holes 28 provided therein. The packing member 19 is a main member of this connecting portion 20. The packing member 19 is interposed between the upstream side openings of the case side liquid flow paths 21 and the downstream side openings of the holder side liquid flow paths 18, thereby connecting these flow paths 18 and 21 with each other in a liquid-tight manner (see FIG. 3). In addition, in the connecting portion 20, the upstream side openings of the case side liquid flow paths 21, which open at positions higher than the bottom surface of the holder attachment portion 23, and the downstream side openings of the holder side liquid flow paths 18, which are provided in the lower portion of the introduction needle holder 12 and in a protruding condition, are connected via the packing member 19. Therefore, the packing member 19 is not entirely pressed but only the regions in contact with the upstream side openings of the case side liquid flow paths 21 and the downstream side openings of the holder side liquid flow paths 18 are pressed. That is to say, in the packing member 19, it is easy to generate a difference in thickness between the regions in contact with the upstream side openings of the case side liquid flow paths 21 and the downstream side openings of the holder side liquid flow paths 18 and the region out of contact therewith. Therefore, the liquid-tight condition between these flow paths 18 and 21 can be further ensured.

As shown In FIG. 3, the supporting wall 25 of the case member 17 is provided with a substrate base portion 31 on the opposite side surface thereof from the introduction needle holder 12 side. To this substrate base portion 31 is fixed a wiring substrate 32. On the wiring substrate 32 are mounted electronic components for various drive signals, and is formed a terminal portion 35 to which is connected the other end side terminal portion 34*b* of a flexible cable 34 of the actuator unit 13 described below. In addition, this wring substrate 32 includes a connector 36. To this connector 36 is electrically connected a control cable (not shown), for example, an FFC (Flexible Flat Cable) extending from a control unit (not shown).

As shown In FIG. 2, the head unit 16, which is attached to the head unit attachment portion 22 of the case member 17, includes the actuator unit 13 and the flow path unit 14, which are laminated together so as to be integrated. The actuator unit 13 includes a pressure chamber plate, a communication opening plate, and a vibrator plate, which are laminated together. The pressure chamber plate has pressure chambers formed therein and corresponding to nozzle openings. The communication opening plate has communication openings formed therein. The vibrator plate has piezoelectric vibrators mounted thereon, which are a kind of pressure sources. In addition, the actuator unit 13 includes a flexible cable 34, such as a TCP (Tape Carrier Package), whose one end side terminal portion 34*a* is electrically connected to input terminal portions 37 of the piezoelectric vibrators. The piezoelectric vibrators In this actuator unit 13 are so-called bending vibration mode piezoelectric vibrators. When these piezoelectric vibrator are driven, that is to say, caused to bending-vibrate, the capacities of the pressure chambers change, and ink drops (a kind of liquid drops) are discharged from the nozzle openings.

Figure 4:
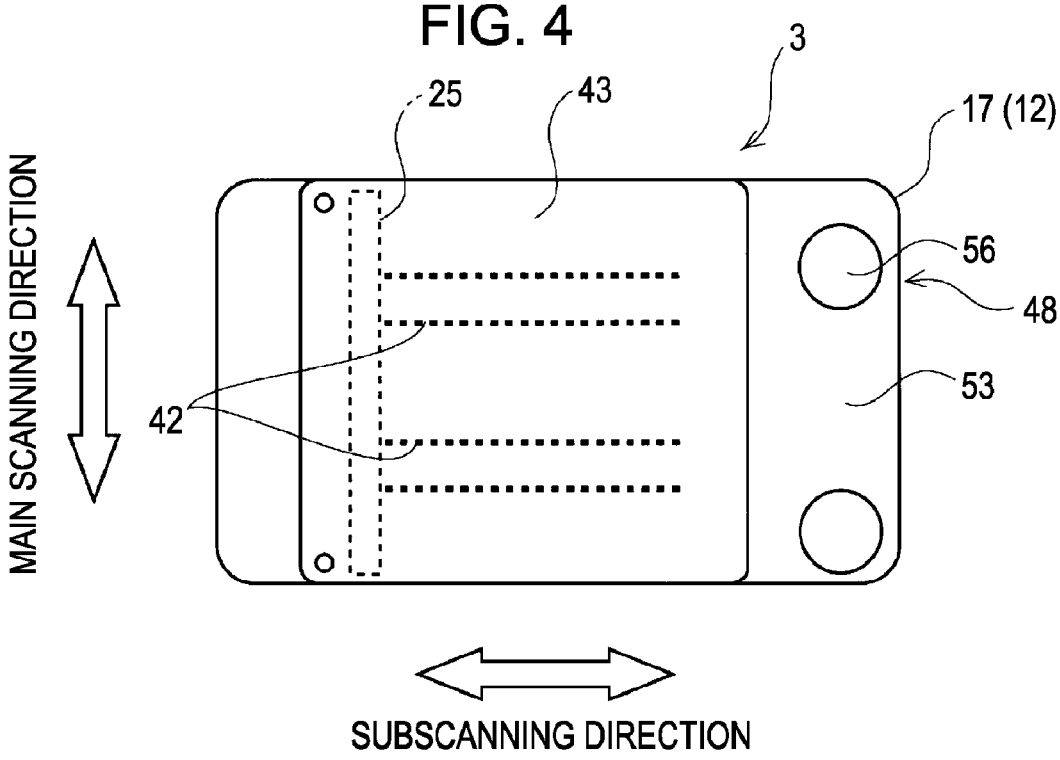
FIG. 4 is a plan view of the recording head viewed from below.

The flow path unit 14 includes a supply opening plate 40, a reservoir plate 41, and a nozzle plate 43 (see FIG. 4). The supply opening plate 40 has ink supply openings 38 and compliance portions 39 that moderate the pressure fluctuations in the reservoirs 27. The reservoir plate 41 has the plurality of reservoirs 27 supplied with ink introduced from the ink cartridge 7 side. The nozzle plate 43 has nozzle lines 42 each including a plurality of nozzle openings aligned In the subscanning direction (the direction perpendicular to the main scanning direction) of the recording head 3. The supply opening plate 40 and the reservoir plate 41 are laminated and joined, for example, with a heat welding film, thereby forming ink flow paths from the reservoirs 27 to the nozzle openings. The nozzle plate 43 is joined to the opposite side surface of the reservoir plate 41 from the surface to which the supply opening plate 40 is joined.

Figure 5:
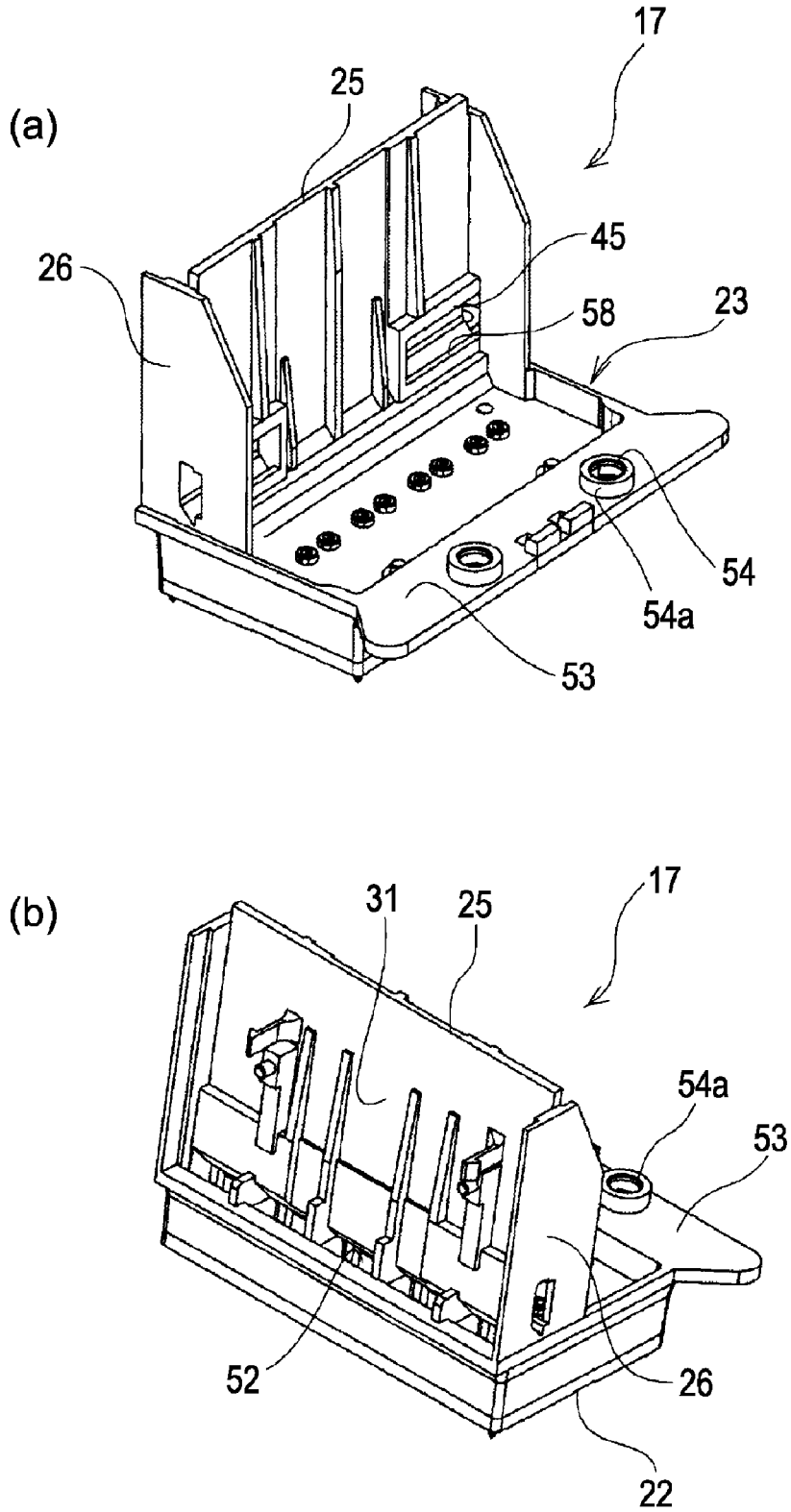
FIG. 5(*a*) is a perspective view of a case member viewed from a direction, and (b) is a perspective view of the case member viewed from another direction.
Figure 6:
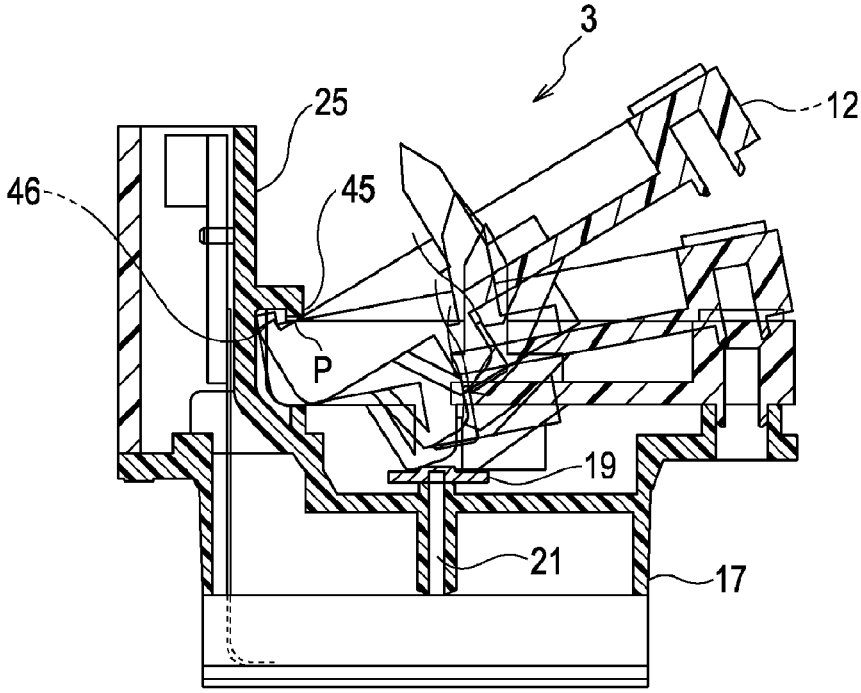
FIG. 6 is a partial sectional view illustrating, in stages, how an introduction needle holder is attached to the case member.
Figure 7:
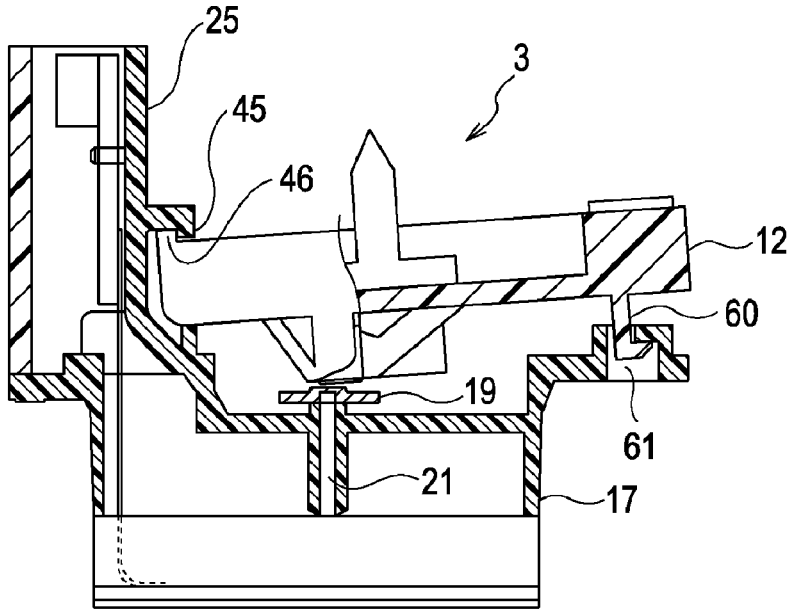
FIG. 7 is a partial sectional view illustrating the introduction needle holder temporarily attached to the case member.

Next, the supporting wall 25 of the case member 17, and how the introduction needle holder 12 is attached to the case member 17 will be described. FIG. 4 is a plan view of the recording head 3 viewed from below. FIG. 5(*a*) is a perspective view of the case member 17 viewed from a direction, and (b) is a perspective view of the case member 17 viewed from another direction. FIG. 6 is a partial sectional view illustrating, In stages, how the introduction needle holder 12 is attached to the case member 17. FIG. 7 is a partial sectional view illustrating the introduction needle holder 12 temporarily attached to the case member 17.

In this embodiment, the recording head 3 has a supporting wall 25 provided on one side of the holder attachment portion 23; the supporting wall 25 has engaging claws 45 on the introduction needle holder 12 side surface thereof; the introduction needle holder 12 has engaged claws 46 provided at one end thereof, the engaged claws 46 being capable of engaging with the engaging claws 45 when the introduction needle holder 12 is attached to the holder attachment portion 23; and the introduction needle holder 12 is fixed by an introduction needle holder fixing portion 48 that fixes the other end of the introduction needle holder 12 to the holder attachment portion 23 of the case member 17 with the engaged claws 46 engaged with the engaging claws 45. If the introduction needle holder 12 is attached to the case member 17 by engaging the engaged claws 46 on one side thereof with the engaging claws 45 as described above, the number of components can be reduced, and the structure for attaching the introduction needle holder 12 to the case member 17 is simpler, compared to the known structure in which every portion is screwed. Therefore, the attachment work can be simplified, the working efficiency can be improved, and thereby the cost can be reduced. In addition, in the case where the supporting wall 25 provided with the engaging claws 45 and the introduction needle holder fixing portion 48 are provided, as shown in FIGS. 3 and 4, in the main scanning direction of the recording head 3, that is to say, the direction of the nozzle lines, it is not necessary to screw the introduction needle holder 12 to flange portions extending from the case member 17 In the subs canning direction, unlike the known art. Therefore, the width of the recording head 3 in the main scanning direction can be reduced. This makes it possible to reduce the size in the main scanning direction of a liquid ejecting apparatus such as the printer 1 including the recording head 3.

As shown In FIGS. 3 and 4, the holder attachment portion 23 of the case member 17 has the supporting wall 25 upstanding on one side thereof in the scanning direction of the recording head 3, that is to say, the direction of the nozzle lines on the nozzle surface (the surface of the nozzle plate 43). In the bottom surface of the holder attachment portion 23 are the openings of the case side liquid flow paths 21. As described above, the supporting wall 25 is provided with the substrate base portion 31 on the opposite side surface thereof from the introduction needle holder 12 side. To this substrate base portion 31 is fixed the wiring substrate 32. That is to say, this supporting wall 25 separates the holder attachment portion 23, in which the connecting portion 20 connecting the holder side liquid flow paths 18 and the case side liquid flow paths 21 is disposed, and the substrate base portion 31, to which the wiring substrate 32 having electronic components and so forth is fixed. Since the holder attachment portion 23 and the substrate base portion 31 are separated, if a liquid, such as ink, leaks from the connecting portion 20 (packing member 19), the ink can be prevented from reaching the wiring substrate 32 side. Therefore, the ink can be prevented from adhering to the wiring substrate 32, and the wiring substrate 32 can be prevented from shorting out, and the electronic components can be prevented from being destroyed.

As shown In FIG. 3, a sloping guide portion 51 that downward slopes from the supporting wall 25 side to the other side of the case member 17 and an opening 52 facing this sloping guide portion 51 are provided in part of the proximal end side of the supporting wall 25. When the head unit 16 with the other end side terminal portion 34*b* of the flexible cable 34 upstanding from the actuator unit 13 is attached to the head unit attachment portion 22, the other end side terminal portion 34*b* of the flexible cable 34 is passed through the opening 52 and is guided along the slope of the sloping guide portion 51 from the head unit attachment portion 22 side to the substrate base portion 31 side. Therefore, the other end side terminal portion 43*b* of the flexible cable 34 can be surely guided to the substrate base portion 32 side, the occurrence of defective assembling can be prevented, and the yield can be improved.

The holder attachment portion 23 of the case member 17 In this embodiment includes the engaging claws 45 provided In the supporting wall 25 upstanding on one side, and the introduction needle holder fixing portion 48 provided on the other side that faces the engaging claws 45 across the upstream side openings of the case side liquid flow paths 21. The engaging claws 45 have a hook-like shape protruding from the introduction needle holder 12 side surface of the supporting wall 25 toward the other side of the holder attachment portion 23. For example, the engaging claws 45 are disposed one on each side of the supporting wall 25 In the main scanning direction. When the introduction needle holder 12 is attached to the holder attachment portion 23, the engaged claws 46 provided so as to protrude upward from one end of the upper surface of the introduction needle holder 12 are engaged with the engaging claws 45 from below.

In addition, as shown in FIG. 5, the holder attachment portion 23 has a flange portion 53 extending outward in the subs canning direction of the recording head 3, that is to say, the direction of the nozzle lines. This flange portion 53 has through holes 54 provided therein, and short cylindrical contact portions 54*a* that are provided on the upper surface of the flange portion 53 and around the through holes 54 and with which the lower portion of the introduction needle holder 12 comes into contact. Each through hole 54 (contact portion 54*a*) is disposed so as to face one of the engaging claws 45 across the upstream side openings of the case side liquid flow paths 21 on a line In the main scanning direction of the recording head 3. In this embodiment, two through holes 54 are provided for two engaging claws 45. In the lower portion of the introduction needle holder 12 and at the positions corresponding to these through holes 54 are provided short cylindrical protrusions each having a screw hole 55 formed therein. With the protrusions fitted in the through holes 54, fixing screws 56 are passed through the through holes 54 from below the flange portion 53 and screwed into the screw holes 55, and thereby the introduction needle holder 12 is fixed to the holder attachment portion 23. By sufficiently screwing the fixing screws 56, the lower portion of the introduction needle holder 12, more specifically, the opening edges of the screw holes 55 are pressed against and fixed to the contact portions 54*a*. Therefore, the positions of the introduction needle holder 12 and the case member 17 in the attachment direction, the main scanning direction, and the subs canning direction can be defined at predetermined positions. Consequently, the introduction needle holder 12 is attached parallel to the attachment direction by the fixing by the introduction needle holder fixing portion 48, the engagement of the engaging claws 45 and the engaged claws 46, and the reaction force of the packing member 19. Therefore, the packing member 19 can be uniformly pressed by the downstream side openings of the holder side liquid flow paths 18 and the upstream side openings of the case side liquid flow paths 21. Therefore, the possibility of ink leakage from the connecting portion 20 can be reduced. The through holes 54, the contact portions 54*a*, the screw holes 55, and the fixing screws 56 constitute the introduction needle holder fixing portion 48 of the invention (see FIG. 3). Due to the reaction force of the packing member 19, a force pressing up the introduction needle holder 12 acts, and the engaging claws 45 can be deformed. However, Since the engaging claws 45 are disposed on the supporting wall and side walls 26 are joined to either side of the supporting wall 25 as shown in FIG. 5, the rigidity of the engaging claws 45 can be improved, and the engaging claws 45 can be prevented from being deformed.

In addition, the holder attachment portion 23 has upright portions 58 provided on the bottom surface thereof on the supporting wall 25 side and in the regions facing the engaging claws 45 with the introduction needle holder 12 therebetween, the upright portions 58 protruding toward the introduction needle holder 12. The upper ends of the upright portions 58 are In contact with the lower portion of the introduction needle holder 12, and thereby the upright portions 58 define the position of the introduction needle holder 12 in the attachment direction. Therefore, when the introduction needle holder 12 is fixed to the case member 17, the packing member 19 disposed between these members can be prevented from being excessively pressed. In addition, when a liquid holding member such as the ink cartridge 7 or a subtank (not shown) is attached, the upright portions 58 also define the position of the introduction needle holder 12 in the attachment direction, and thereby the packing member 19 is not excessively pressed.

The introduction needle holder 12 of this embodiment has the engaged claws 46 at one end of the upper surface thereof, and the downstream side openings of the holder side liquid flow paths 18 provided In the lower portion thereof below these engaged claws 46. In the case where the downstream side openings of the holder side liquid flow paths 18 are disposed below the rotation center P as described above, when the introduction needle holder 12 is attached to the case member 17 and the downstream side openings of the holder side liquid flow paths 18 come into contact with and press the packing member 19, the downstream side openings are substantially parallel to the upper surface of the packing member 19 as shown in FIG. 6. Therefore, the packing member 19 can be prevented from being displaced from the predetermined position when the introduction needle holder 12 is attached to the case member 17.

In addition, In this embodiment, as shown in FIG. 7, the introduction needle holder 12 may have a hook 60 protruding downward from the other end thereof, and the holder attachment portion 23 may have a hook hole 61 at a position corresponding to the hook 60. When the introduction needle holder 12 is attached to the case member 17, after the engaged claws 46 are engaged with the engaging claws 45, the hook 60 is engaged with the hook hole 61, and thereby the introduction needle holder 12 can be temporarily attached to the case member 17. Due to the temporary attachment with the hook 60, the introduction needle holder 12 need not be held by hand until the screwing with the fixing screws 56, and the work is facilitated. In addition, the introduction needle holder 12 can be left in the temporary attachment state over a prolonged period of time, and in this case foreign substance can be prevented from entering the liquid flow paths.

In the above embodiment, screwing is used In the introduction needle holder fixing portion 48. However, the present invention is not limited to this. Any means can be used as long as the introduction needle holder 12 can be positioned at a predetermined position and fixed to the case member 17. For example, such caulking can be used that a fixing pin provided In one of the case member 17 and the introduction needle holder 12 is passed through a through hole provided in the other and then the tip of the fixing plan protruding from the through hole is thermally deformed.

Figure 8:
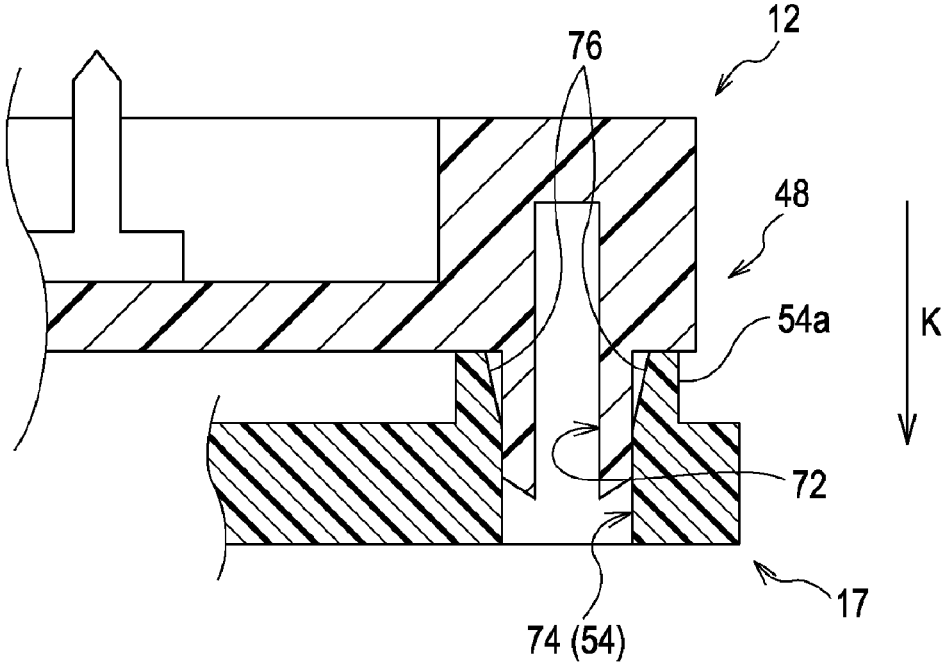
FIG. 8 is a partial sectional view showing an introduction needle holder fixing portion according to another embodiment.

Next, a liquid ejecting head according to another embodiment of the invention will be described with reference to FIG. 8. The same reference numerals will be used to designate the same components as those in the above described embodiment, so that the description will be omitted.

The introduction needle holder fixing portion 48 of this embodiment also functions as a positioning guide for the attachment of the introduction needle holder 12 to the case member 17. The introduction needle holder 12 has a cylindrical protrusion 72 protruding toward the case member 17. The case member 17 has a short cylindrical contact portion 54*a* having a through hole 54 functioning as a recess 74. Into this recess 74, the above-described protrusion 72 can be inserted.

The protrusion 72 has a hollow cylindrical shape extending from the lower surface of the introduction needle holder 12 toward the case member 17 along the direction of attachment of the introduction needle holder 12 to the holder attachment portion 23 (hereinafter referred to as "direction K"). At the circular tip thereof is formed a tapered surface steeply tapering downward.

The recess 74 is a hole converted from the through hole 54 of the short cylindrical contact portion 54*a* extending through the case member 17. On the inner peripheral surface thereof on the side of the contact portion 54*a* is formed a tapered surface 76 (part of the tapered sliding surface of the recess) whose diameter is largest at the upper end opening and that gradually tapers downward. The diameter of the tapered sliding surface of the recess other than the tapered surface 76, i.e., the smallest diameter straight surface (part of the tapered sliding surface of the recess) is set to such an inner diameter that the protrusion 72 is tightly fitted therein. The contact portion 54*a* having the recess 74 comes into contact with the lower surface of the introduction needle holder 12 and thereby defines the distance between the introduction needle holder 12 and the case member 17. Therefore, the protruding length thereof is set to a predetermined length corresponding to the distance. On the other hand, the protruding length of the protrusion 72 is set to such a length that the protrusion 72 and the recess 74 can start to engage with each other before the packing member 19 is pinched between the case member 17 and the introduction needle holder 12 when the introduction needle holder 12 is attached to the holder attachment portion 23. For the recess 74, the size of the opening is set to such a size that the protrusion 72 can smoothly fitted into the recess 74 without coming into contact with the protruding portion around the recess 74 when the protrusion 72 starts to be fitted into the recess 74.

Figure 9:
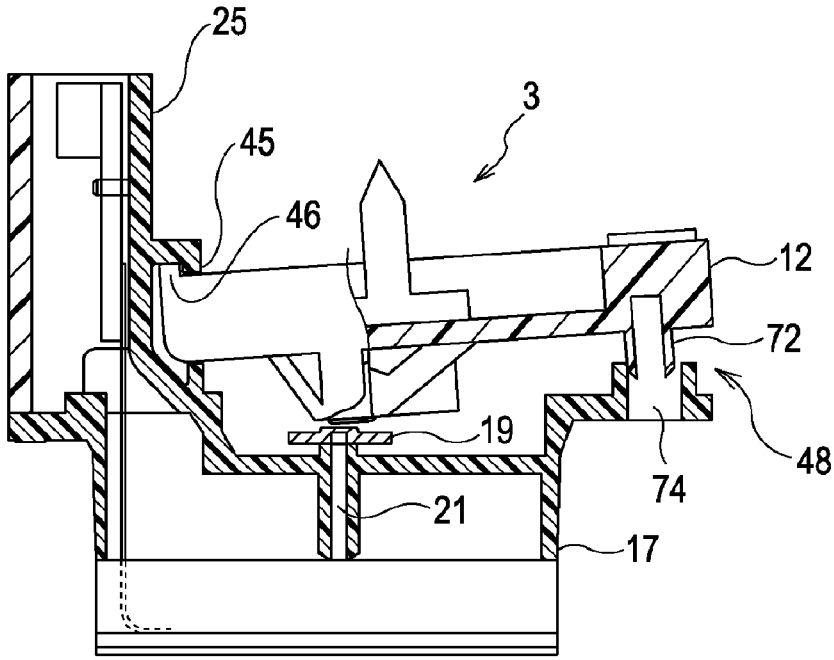
FIG. 9 is a partial sectional view illustrating a state in which an introduction needle holder is being attached to a case member according to another embodiment.

The liquid ejecting head 3 including the introduction needle holder fixing portion 48 having such protrusion 72 and recess 74 is assembled as follows. First, the engaging claws 45 of the introduction needle holder 12 and the engaged claws 46 of the case member 17 are engaged with each other, and then the introduction needle holder 12 is rotates so that the protrusion 72 of the introduction needle holder 12 and the recess 74 of the case member 17 approach each other. As shown in FIG. 9, the tip of the protrusion 72 starts to engage with the recess 74. In this state, as shown in FIG. 9, there is a gap between the packing member 19 and the introduction needle holder 12, and the packing member is not pressed. The protrusion 72 of the introduction needle holder 12 and the recess 74 of the case member 17 are then brought closer to each other, and the protrusion 72 slides along the tapered sliding surface of the recess 74 and thereby moves along the attachment direction K. Guided along the attachment direction K, the protrusion 72 is deeply inserted into the recess 74. After a sufficient rotation, the protrusion 72 and the recess 74 become very close to each other, and the upstream side openings of the case side liquid flow paths 21 and the downstream side openings of the holder side liquid flow paths 18 move along the attachment direction K and pinch the packing member 19. Just before the packing member 19 is pinched between the introduction needle holder 12 and the case member 17, the protrusion 72 and the recess 74, sliding straight, engage with each other. When the introduction needle holder 12 comes into contact with the packing member 19, the introduction needle holder 12 is substantially parallel to the surface of the packing member 19 and can uniformly press the packing member 19. Therefore, when the introduction needle holder 12 is attached to the case member 17, the packing member 19 can be prevented from being displaced from the predetermined position, and the flow paths 18 and 21 can be prevented from being staggered. After the packing member 19 is pinched, the introduction needle holder 12 can be fixed to the case member 17 with fixing screws 56 as in the above embodiment. For the introduction needle holder 12 and the case member 17, only parts of them are joined by the engagement of the downward facing engaging claws 45 and the upward-facing engaged claws 46. In this engaging state, there is a slight backlash in the vertical direction. Therefore, just before the packing member 19 is pressed, the protrusion 72 and the recess 74 can move smoothly and straight.

Figure 10:
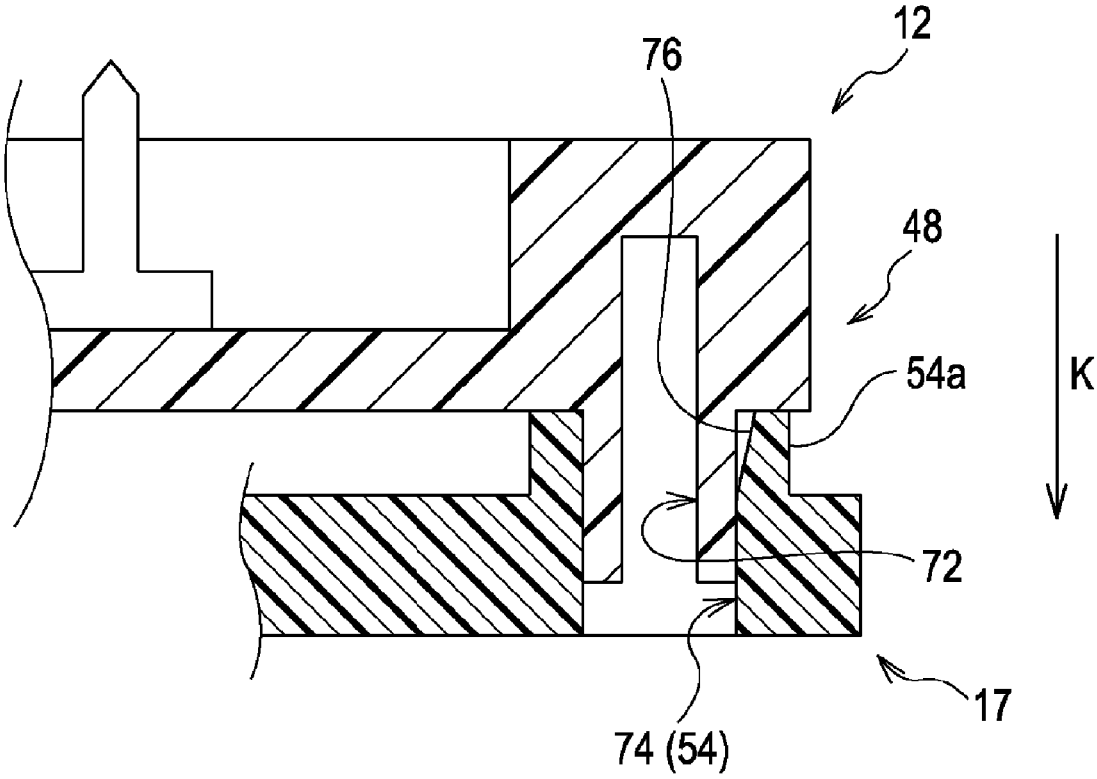
FIG. 10 is a modification of a partial sectional view showing an introduction needle holder fixing portion according to another embodiment.

In this embodiment, a tapered sliding surface is formed on the entire inner periphery of the recess 74. Alternatively, a tapered sliding surface may be formed only in part of the recess 74 as shown in FIG. 10. Still alternatively, a tapered sliding surface may be formed on the outer peripheral surface of the protrusion 72, by forming a tapered surface gradually tapering from the proximal end toward the distal end. Yet alternatively, the outer peripheral surface of the protrusion 72 and the inner peripheral surface of the recess 74 may each have a tapered sliding surface. For the placement of the protrusion 72 and the recess 74, the protrusion 72 may be provided in the case member 17, and the recess 74 may be provided in the introduction needle holder 12. That is to say, in whichever of the introduction needle holder 12 and the case member 17 the protrusion 72 or the recess 74 may be provided, the protrusion 72 and the recess 74 can form the introduction needle holder fixing portion 48. The protrusion 72 and the recess 74 can be provided independently of the introduction needle holder fixing portion 48.

The invention can be applied not only ink jet recording heads but also other liquid ejecting heads, for example, color material ejecting heads used for manufacturing color filters of liquid crystal displays, electrode material ejecting heads used for forming electrodes of organic EL (Electro Luminescence) displays and FEDs (field emission displays), and bioorganic matter ejecting heads used for manufacturing biochips as long as they include components disposed one on the top of another.

The invention claimed is:

1. A liquid ejecting head comprising:

a case member including a head unit including a nozzle line having a plurality of aligned nozzle openings, the head unit being capable of discharging liquid in a pressure chamber from the nozzle openings in the form of liquid drops by driving a pressure source; and an introduction needle holder including an introduction needle introducing liquid in a liquid holding member that is an ink cartridge or subtank into a liquid flow path communicating with the pressure chamber, wherein:

the introduction needle holder includes a holder side liquid flow path that supplies liquid introduced from the liquid introduction needle to the case member side, the case member includes a case side liquid flow path that supplies liquid supplied from the holder side liquid flow path of the introduction needle holder to the pressure chamber side;

the case member includes a head unit attachment portion to which the head unit is attached, a holder attachment portion that is located on the opposite side from the head unit attachment portion and to which the introduction needle holder is attached, and a supporting wall provided on one side of the holder attachment portion;

the supporting wall includes an engaging claw thereof; and the introduction needle holder includes an engaged claw capable of being engaged with the engaging claw and provided at one end thereof, the liquid ejecting head further comprising an introduction needle holder fixing portion that fixes the other end of the introduction needle holder to the holder attachment portion of the case member.

2. The liquid ejecting head according to claim 1, wherein:

one of the case member and the introduction needle holder is provided with a protrusion protruding toward the other, the other is provided with a recess into which the protrusion can be fitted;

at least one of the protrusion and the recess is provided with a tapered sliding surface that slides and thereby guides the attachment direction;

a packing member for connecting the holder side liquid flow path and the case side liquid flow path with each other In a liquid-tight manner is disposed between the case member and the introduction needle holder; and the protrusion and the recess engage with each other before the packing member is pinched between the case member and the introduction needle holder when the introduction needle holder is attached to the holder attachment portion.

3. The liquid ejecting head according to claim 2, wherein the protrusion and the recess constitute the introduction needle holder fixing portion.

4. The liquid ejecting head according to claim 3, wherein: the case member includes a wring substrate that supplies a drive signal to the pressure source; and the supporting wall is provided with a substrate base portion on the opposite side surface thereof from the surface on which the engaging claw is disposed, and the wiring substrate is fixed to the substrate base portion.

5. The liquid ejecting head according to claim 1, wherein:

the case member includes a wring substrate that supplies a drive signal to the pressure source; and the supporting wall is provided with a substrate base portion on the opposite side surface thereof from the surface on which the engaging claw is disposed, and the wiring substrate is fixed to the substrate base portion.

6. The liquid ejecting head according to claim 5, wherein:

the head unit includes a flexible cable one end side terminal portion of which is connected to an input terminal portion of the pressure source and the other end side terminal portion of which is connected to a terminal portion of the wiring substrate;

a sloping guide portion that downward slopes from the supporting wall side to the other side of the case member and an opening facing the sloping guide portion are provided In part of the proximal end side of the supporting wall; and when the head unit with the other end side terminal portion of the flexible cable upstanding from the pressure source is attached to the head unit attachment portion, the other end side terminal portion of the flexible cable is passed through the opening and is guided along the slope of the sloping guide portion from the head unit attachment portion side to the substrate base portion side.

7. The liquid ejecting head according to claim 6, wherein: the holder attachment portion is provided with an upright portion on the supporting wall side thereof, the upright portion protruding toward the introduction needle holder; and the upper end of the upright portion is In contact with the lower portion of the introduction needle holder and thereby defines the position of the introduction needle holder In the attachment direction.

8. The liquid ejecting head according to claim 7, wherein the introduction needle holder fixing portion uses screwing.

9. The liquid ejecting head according to claim 8, wherein the introduction needle holder fixing portion uses such caulking that a fixing pin provided In one of the case member and the introduction needle holder is passed through a through hole provided in the other and then the tip of the fixing pin protruding from the through hole is thermally deformed.

10. The liquid ejecting head according to claim 1, wherein:

the holder attachment portion is provided with an upright portion on the supporting wall side thereof, the upright portion protruding toward the introduction needle holder; and the upper end of the upright portion is In contact with the lower portion of the introduction needle holder and thereby defines the position of the introduction needle holder In the attachment direction.

11. The liquid ejecting head according to claim 1, wherein the introduction needle holder fixing portion uses screwing.

12. The liquid ejecting head according to claim 1, wherein the introduction needle holder fixing portion uses such caulking that a fixing pin provided In one of the case member and the introduction needle holder is passed through a through hole provided in the other and then the tip of the fixing pin protruding from the through hole is thermally deformed.

13. A method for assembling a liquid ejecting head comprising:

a case member including a head unit including a nozzle line having a plurality of aligned nozzle openings, the head unit being capable of discharging liquid in a pressure chamber from the nozzle openings in the form of liquid drops by driving a pressure source; and an introduction needle holder including an introduction needle introducing liquid in a liquid holding member into a liquid flow path communicating with the pressure chamber, the liquid holding member comprising an ink cartridge or subtank, wherein:

the introduction needle holder includes a holder side liquid flow path that supplies liquid introduced from the liquid introduction needle to the case member side, the case member includes a case side liquid flow path that supplies liquid supplied from the holder side liquid flow path of the introduction needle holder to the pressure chamber side;

the case member includes a head unit attachment portion to which the head unit is attached, a holder attachment portion that is located on the opposite side from the head unit attachment portion and to which the introduction needle holder is attached, and a supporting wall provided on one side of the holder attachment portion;

the supporting wall includes an engaging claw on the introduction needle holder side surface thereof; and the introduction needle holder includes an engaged claw capable of being engaged with the engaging claw and provided at one end thereof, the method comprising fixing the other end of the introduction needle holder to the holder attachment portion of the case member with the engaged claw engaged with the engaging claw.

* * * * *